US010328449B2

(12) United States Patent
Hong et al.

(10) Patent No.: US 10,328,449 B2
(45) Date of Patent: Jun. 25, 2019

(54) PIEZOELECTRIC DISPENSER AND METHOD OF CALIBRATING STROKE OF THE SAME

(71) Applicant: PROTEC CO., LTD, Incheon (KR)

(72) Inventors: Seung Min Hong, Incheon (KR); Hansung Lee, Bucheon-si (KR)

(73) Assignee: Protec Co., Ltd., Incheon (KR)

( * ) Notice: Subject to any disclaimer, the term of this patent is extended or adjusted under 35 U.S.C. 154(b) by 283 days.

(21) Appl. No.: 14/945,295

(22) Filed: Nov. 18, 2015

(65) Prior Publication Data

US 2016/0136661 A1 May 19, 2016

(30) Foreign Application Priority Data

Nov. 18, 2014 (KR) ..... 10-2014-0160691

(51) Int. Cl.
*B05C 5/02* (2006.01)
*B05B 17/06* (2006.01)

(52) U.S. Cl.
CPC ..... *B05C 5/0225* (2013.01); *B05B 17/0607* (2013.01)

(58) Field of Classification Search
CPC .. B05C 5/0225; B05B 17/0607; G06M 1/108; H01L 21/563; G07C 3/02; F04B 17/003; F04B 17/03; F04B 49/06
USPC ..... 239/1, 583
See application file for complete search history.

(56) References Cited

U.S. PATENT DOCUMENTS

| | | | | |
|---|---|---|---|---|
| 5,733,597 | A | 3/1998 | Schmitkons et al. | |
| 9,429,368 | B2 * | 8/2016 | Hong | F04B 43/04 |
| 9,636,699 | B2 * | 5/2017 | Doyle | B05C 5/0225 |
| 2013/0026197 | A1 * | 1/2013 | Felix | B05C 5/0225 222/504 |
| 2014/0263688 | A1 | 9/2014 | Doyle et al. | |
| 2015/0302292 | A1 * | 10/2015 | Hong | F04B 17/03 377/15 |
| 2015/0367376 | A1 * | 12/2015 | Doyle | B05C 5/0225 222/1 |

FOREIGN PATENT DOCUMENTS

| | | | | |
|---|---|---|---|---|
| JP | 1991-015674 | A | 1/1991 | |
| KR | 10-1041067 | B1 | 6/2011 | |
| KR | 10-1100828 | B1 | 1/2012 | |
| KR | 10-1301107 | B1 | 8/2013 | |
| KR | 101301107 | * | 8/2013 | F04B 43/04 |

* cited by examiner

*Primary Examiner* — Alexander M Valvis
*Assistant Examiner* — Qingzhang Zhou
(74) *Attorney, Agent, or Firm* — Knobbe Martens Olson & Bear LLP

(57) ABSTRACT

A piezoelectric dispenser having a uniform dispensing quality of a viscous liquid by calibrating an operation stroke of a valve rod discharging a viscous liquid (vertical operation displacement of the valve rod) by setting the operation stroke of the valve rod to an initial value during use, and a method of calibrating the operation stroke of the piezoelectric dispenser. Accordingly, a uniform dispensing accuracy of viscous liquid may be maintained, and degradation of the dispensing quality of a viscous liquid due to abrasion of components may be reduced.

6 Claims, 9 Drawing Sheets

PIEZOELECTRIC DISPENSER AND METHOD OF CALIBRATING STROKE OF THE SAME

CROSS-REFERENCE TO RELATED APPLICATION

This application claims the benefit of Korean Patent Application No. 10-2014-0160691, filed on Nov. 18, 2014, in the Korean Intellectual Property Office, the disclosure of which is incorporated herein in its entirety by reference.

BACKGROUND

1. Field

The present disclosure relates to a liquid dispenser for dispensing liquid by using a piezoelectric actuator, and a method of dispensing liquid using the same.

2. Description of the Related Technology

A liquid dispenser supplies a liquid solution such as water, oil, or resin of a predetermined amount and is used in diverse fields, for example, in a semiconductor process or in the medical field.

In particular, a liquid dispenser is frequently used in an underfill process of a semiconductor process, that is, to fill a package of a semiconductor device with a resin. In a process of manufacturing a light emitting diode (LED) device, a dispenser is used in a process of coating a LED chip with a phosphorescent solution which is a mixture of a phosphorescent material and a resin.

In liquid dispensers as described above, a pump receiving a viscous liquid and dispensing a fixed amount of the viscous liquid at an exact position is used as a core device.

Various pump structures such as a screw pump and a linear pump are available. Recently, a piezoelectric pump, in which a piezoelectric element is used as an actuator, has been developed and used to perform a fast dispensing operation in a semiconductor process or the like. Korean Patent No. KR 10-1301107 (published on Aug. 14, 2013) discloses a piezoelectric pump.

SUMMARY

One aspect of the invention provides a liquid dispenser apparatus, which may comprise: a valve assembly comprising a nozzle and a valve rod with a tip facing the nozzle, the valve rod configured to move along a first axis; at least one piezoelectric actuator configured to expand and shrink along a second axis in response to a voltage signal applied to the at least one piezoelectric actuator, the second axis being identical to or different from the first axis; a lever configured to move pivotally about a pivotal axis thereof and operably connected to the at least one piezoelectric actuator such that the lever pivotally moves as the at least one piezoelectric actuator expands and shrinks along the second axis; wherein the valve rod and the lever are operably connected such that, as the lever pivotally moves, the valve rod moves along the first axis and the tip reciprocates between a first position and a second position for dispensing liquid through the nozzle, wherein the second position changes over use of the liquid dispenser such that a stroke of the tip between the first position and the second position becomes longer or shorter; a lever-position detector connected to the lever and configured to detect the lever's position that is indicative of the tip's position; and at least one processor configured to process information from the lever-position detector to determine if the first position needs to be adjusted, and upon determining that the first position needs to be adjusted, to generate a control signal for changing the voltage signal applied to the at least one piezoelectric actuator to adjust a level of expansion and shrinkage thereof along the second axis, which causes to adjust pivotal movement of the lever, which to further change the first position.

In the foregoing apparatus, the at least one processor may be configured to determine if the first position needs to be adjusted by computing a distance of the stroke and then comparing the distance to the reference value. The at least one processor is configured to determine that the first position needs to be adjusted when the stroke has become longer than the reference value. The tip may contact the nozzle at the second position, wherein the stroke of the tip may become longer over use of the liquid dispenser as a valve seat of the nozzle wears out by repeated impacts of the tip. For determining if the first position needs to be adjusted, the at least one processor may be configured to determine if the stroke of the tip has become longer than a reference value based on information from the lever-position detector, wherein the at least one processor is configured to determine that the first position needs to be adjusted when the stroke has become longer than the reference value, wherein the change of the first position is to make the stroke shorter than the reference value. The at least one processor may be configured to determine if the stroke of the tip has become longer than the reference value by computing a distance of the stroke and then comparing the distance to the reference value.

Still in the foregoing apparatus, the at least one processor may be configured to determine if the first position needs to be adjusted by computing the second position of the tip based on the information from the lever-position detector and then comparing the second position of the tip to a reference position. The voltage signal may be configured to operate the at least one piezoelectric actuator such that the tip of the valve rod would move to a third position beyond the second position if the nozzle does not stop the valve rod's movement, wherein an over-stroke defined by a distance between the second position and the third position becomes shorter a reference distance when the stroke of the tip becomes longer than a reference value, wherein the at least one processor is configured to generate the control signal which is to change the third position such that the over-stroke is greater than the reference distance.

Further in the foregoing apparatus, the lever's position may be a displacement of the lever, which is a position of the lever relative to a reference position of the lever. The lever-position detector may be a displacement sensor configured to sense the lever's position indicative of the tip's position relative to the first position or the second position and further configured to provide the information indicative of the lever's position to the at least one processor. The at least one piezoelectric actuator may comprise a first piezoelectric actuator and a second piezoelectric actuator, wherein the first piezoelectric actuator is configured to expand and the second piezoelectric actuator is configured to shrink to place the tip of the valve rod to the first position, wherein when the stroke of the tip becomes longer than a reference value, the at least one processor is configured to generate the control signal to reduce the amount of the expansion of the first piezoelectric actuator and the amount of the shrinkage of the second piezoelectric actuator for changing the first position of the tip of the valve rod.

Another aspect of the invention provides a method of dispensing liquid, which may comprise: providing the foregoing liquid dispenser apparatus; applying a voltage signal to the at least one piezoelectric actuator for its expansion and shrinkage along the second axis, which causes pivotal movement of the lever, which then to cause movement of the valve rod along the first axis such that the valve assembly dispenses liquid through the nozzle as the tip reciprocates between the first position and the second position at which the tip contacts the nozzle; detecting the lever's position that is indicative of the tip's position; processing information from the lever-position detector to determine if the first position needs to be adjusted; and upon determining that the first position needs to be adjusted, generating a control signal for changing the voltage signal applied to the at least one piezoelectric actuator to adjust a level of expansion and shrinkage thereof along the second axis, which causes to adjust pivotal movement of the lever, which to further change the first position.

In the foregoing method, determining if the first position needs to be adjusted may comprise computing a distance of the stroke and then comparing the distance to the reference value. It may be determined that the first position needs to be adjusted when the stroke has become longer than the reference value. The tip may contact the nozzle at the second position, wherein the stroke of the tip becomes longer over use of the liquid dispenser as a valve seat of the nozzle wears out by repeated impacts of the tip. Determining if the first position needs to be adjusted may comprise determining if the stroke of the tip has become longer than a reference value based on information from the lever-position detector, wherein it is determined that the first position needs to be adjusted when the stroke has become longer than the reference value, wherein the change of the first position is to make the stroke shorter than the reference value. Determining if the stroke of the tip has become longer than the reference value may comprise computing a distance of the stroke and then comparing the distance to the reference value.

Still in the foregoing method, determining if the first position needs to be adjusted may comprise computing the second position of the tip based on the information from the lever-position detector and then comparing the second position of the tip to a reference position. The voltage signal may operate the at least one piezoelectric actuator such that the tip of the valve rod would move to a third position beyond the second position if the nozzle does not stop the valve rod's movement, wherein an over-stroke defined by a distance between the second position and the third position becomes shorter than a reference distance when the tip's stroke between the first position and the second position becomes longer than a reference value, wherein the control signal is to change the third position for increasing the over-stroke distance to be greater the reference distance.

Further in the foregoing method, the lever's position may be a displacement of the lever, which is a position of the lever relative to a reference position of the lever. The lever-position detector may be a displacement sensor which senses the lever's position indicative of the tip's position relative to the first position or the second position and provides the information indicative of the lever's position to the at least one processor. The at least one piezoelectric actuator may comprise a first piezoelectric actuator and a second piezoelectric actuator, wherein the first piezoelectric actuator expands and the second piezoelectric actuator shrinks to place the tip of the valve rod to the first position, wherein when the stroke of the tip becomes longer than a reference value, the control signal is to reduce the amount of the expansion of the first piezoelectric actuator and the amount of the shrinkage of the second piezoelectric actuator for changing the first position of the tip of the valve rod.

One or more embodiments include a piezoelectric dispenser capable of maintaining a uniform dispensing quality of a viscous liquid by calibrating an operation stroke of a valve rod discharging a viscous liquid (vertical operation displacement of the valve rod) by setting the operation stroke of the valve rod to an initial value when the operation stroke of the valve rod is changed during use due to factors such as assembly tolerance or abrasion of components.

Additional aspects will be set forth in part in the description which follows and, in part, will be apparent from the description, or may be learned by practice of the presented embodiments.

According to one or more embodiments, a piezoelectric dispenser includes: a pump body; a discharge instrument including a lever that is rotatably mounted with respect to a hinge axis mounted in the pump body and a valve rod that is liftably connected to the lever according to rotation of the lever; a piezoelectric actuator having an end that is mounted in the pump body and contactable to the lever, wherein when a voltage is applied to the piezoelectric actuator, a length of the piezoelectric actuator is increased and the piezoelectric actuator pressurizes the lever so as to rotate the lever with respect to the hinge axis; a valve body including a reservoir into which an end of the valve rod is inserted and in which a viscous liquid is stored, an inlet through which the viscous liquid flows into the reservoir, and a discharge outlet through which the viscous liquid of the reservoir is discharged according to advance and retreat of the valve rod in the reservoir; a displacement measurement sensor installed in the pump body and measuring an operation displacement of the lever of the discharge instrument; and a controller for calculating a difference between an operation stroke S_o of the valve rod of the discharge instrument (vertical operation displacement of the valve rod) calculated based on the measured operation displacement of the lever of the displacement measurement sensor and a preset initial operation stroke S_i of the valve rod and controlling a voltage to be applied to the piezoelectric actuator so as to calibrate the operation stroke of the valve rod by offsetting the operation stroke of the valve rod.

According to one or more embodiments, a method of calibrating an operation stroke of a piezoelectric dispenser, includes: (a) applying a voltage to a piezoelectric actuator of a piezoelectric pump of the piezoelectric dispenser and measuring an operation displacement of a lever of the piezoelectric pump generated by the piezoelectric actuator, wherein the piezoelectric pump comprises the lever that is rotatably mounted with respect to a hinge axis, a valve rod that is connected to the lever and lifted or lowered according to rotation of the lever, wherein when a voltage is applied to the piezoelectric actuator, a length of the piezoelectric actuator is increased and the piezoelectric actuator pressurizes the lever so as to rotate the lever with respect to the hinge axis, a reservoir into which an end of the valve rod is inserted and in which a viscous liquid is stored, an inlet through which the viscous liquid flows into the reservoir, and a discharge outlet through which the viscous liquid of the reservoir is discharged according to advance and retreat of the valve rod in the reservoir; (b) calculating an operation stroke S_o of the valve rod (vertical operation displacement of the valve rod) based on the operation displacement of the lever; (c) comparing the calculated operation stroke S_o and a preset initial operation stroke S_i of the valve rod; and (d) calibrating the operation stroke S_o of the valve rod by offsetting the operation stroke S_o of the valve rod by controlling a voltage to be applied to the piezoelectric actuator when there is a difference between the operation stroke S_o and the preset initial operation stroke S_i of the valve rod.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

The inventive concept will now be described more fully with reference to the accompanying drawings, in which embodiments of the inventive concept are shown.

In one embodiment, a liquid dispenser includes a pump body and a valve body that are separably coupled to each other. A hinge axis is mounted in the pump body, and a lever that extends horizontally is rotatably mounted with respect to the hinge axis. A valve rod that extends vertically is inserted into the valve body. The lever and the valve rod are connected to each other so that when the lever rotates with respect to the hinge axis, the valve rod is vertically lifted or lowered. A pair of piezoelectric actuators are installed in the pump body to rotate the lever with respect to the hinge axis. The pair of piezoelectric actuators are formed of piezoelectric elements whose length is increased or reduced according to an electrical potential of a voltage applied to the piezoelectric actuators.

In the foregoing liquid dispenser, when the valve body is separated from the pump body and then they are reassembled for maintenance, repair or cleaning of components of the piezoelectric pump, and then reassembling the same, a discharge amount of a viscous liquid may be different from the discharge amount thereof before reassembling. When the valve body is operated after reassembling, an operation stroke of the valve rod may be changed due to, for example, assembly tolerance. This may cause a difference in an actual discharge amount of the liquid from an initial discharge amount of viscous liquid. Such a difference between an actual discharge amount and a preset initial discharge amount of a viscous liquid may also be caused by abrasion of components such as a lever or a valve rod. For example, while using the dispenser, a valve seat of a nozzle in the valve body wears out by repeated impacts of the tip of a valve rod. This may cause changes in the dispensing amount of the liquid.

Figure 1:
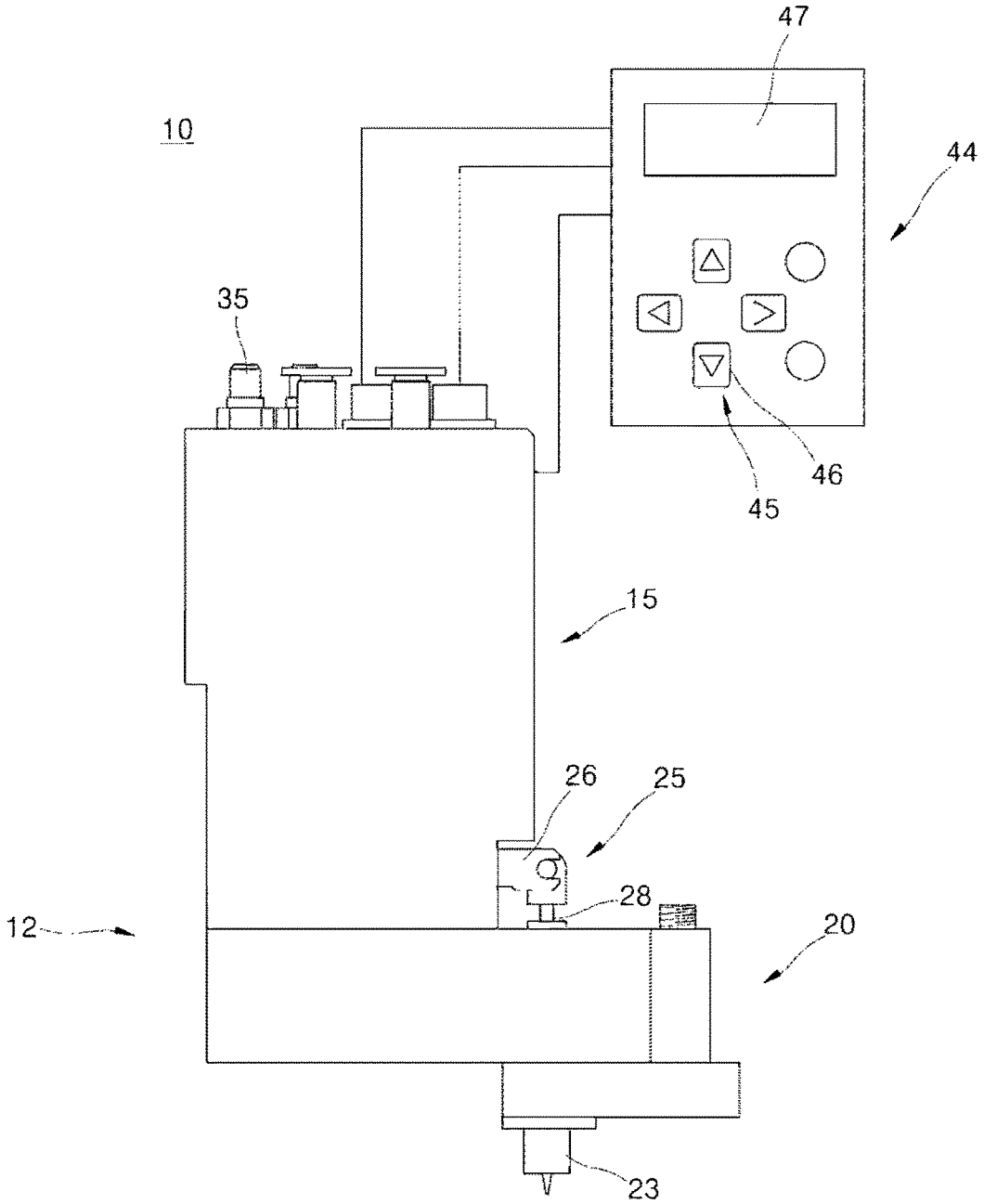
FIG. 1 is a front view of a piezoelectric dispenser according to an embodiment of the inventive concept.
Figure 2:
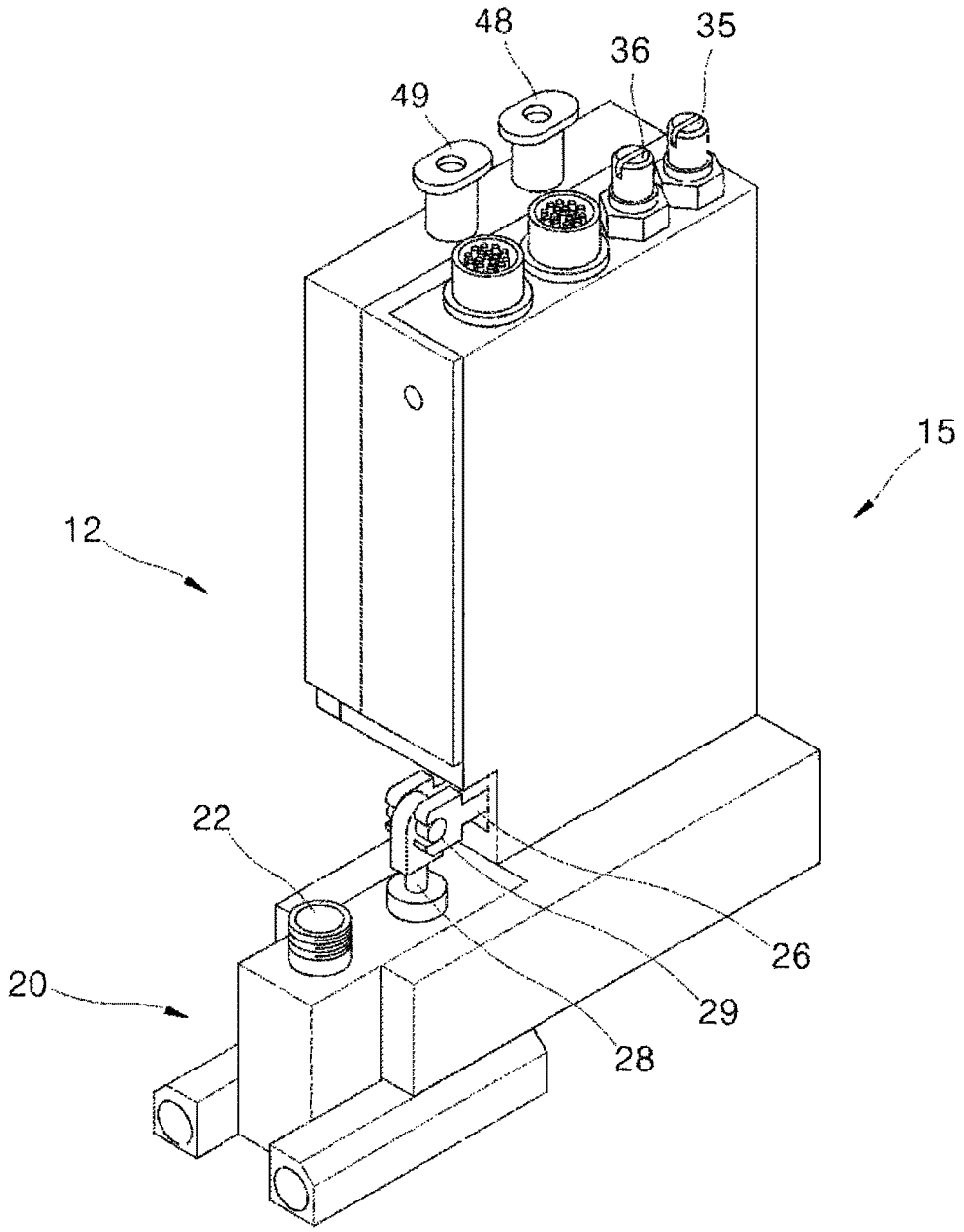
FIG. 2 is a perspective view of a piezoelectric pump of the piezoelectric dispenser illustrated in FIG. 1.
Figure 3:
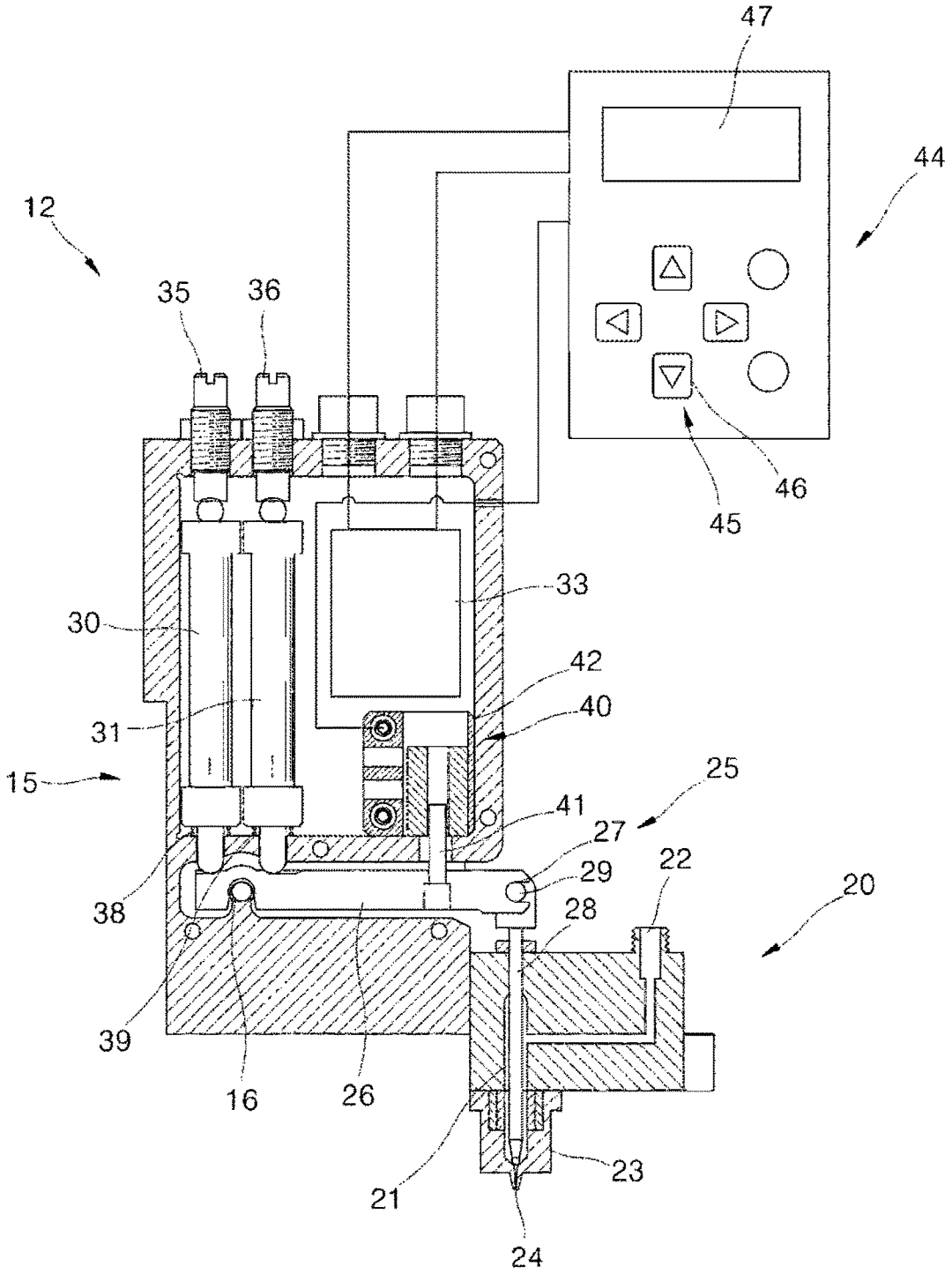
FIG. 3 is a cross-sectional view of a piezoelectric pump of the piezoelectric dispenser of FIG. 1.

FIG. 1 is a front view of a piezoelectric dispenser 10 according to an embodiment of the inventive concept. FIG. 2 is a perspective view of a piezoelectric pump 12 of the piezoelectric dispenser 10 illustrated in FIG. 1. FIG. 3 is a cross-sectional view of the piezoelectric pump 12 of the piezoelectric dispenser 10 of FIG. 1.

As illustrated in FIGS. 1 through 3, the piezoelectric dispenser 10 according to the embodiment of the inventive concept includes the piezoelectric pump 12, a displacement measurement sensor 40, and a controller 44. The piezoelectric pump 12 includes a pump body 15, a valve body 20, a discharge instrument 25, first and second piezoelectric actuators 30 and 31, and a pump control unit 33. The pump control unit 33 applies a voltage to the first and second piezoelectric actuators 30 and 31 to control operations of the first and second piezoelectric actuators 30 and 31. The pump body 15 and the valve body 20 are separably coupled to each other via a fixing member such as a bolt. The discharge instrument 25 includes a lever 26 mounted in the pump body 15 and a valve rod 28 that is mounted in the valve body 20 and is connectable to the lever 26.

The valve body 20 includes a reservoir 21, an inlet 22, and a nozzle 23. The reservoir 21 is in the form of a container that is opened upwardly, and the valve rod 28 is inserted into the reservoir 21 to tightly seal an upper portion of the reservoir 21. The inlet 22 is connected to the reservoir 21. A viscous liquid supplied from the outside through the inlet 22 is transmitted to the reservoir 21. The viscous liquid of the reservoir 21 is discharged to the outside through a discharge outlet 24 of the nozzle 23.

Referring to FIG. 3, a hinge axis 16 is mounted in the pump body 15, and the lever 26 that extends horizontally is rotatably mounted with respect to the hinge axis 16. The valve rod 28 that extends vertically is inserted into the valve body 20. The lever 26 and the valve rod 28 are connected to each other so that when the lever 26 rotates with respect to the hinge axis 16, the valve rod 28 is vertically lifted or lowered.

The valve rod 28 connected to the lever 26 is lifted or lowered with respect to the reservoir 21 according to rotation of the lever 26. As the valve rod 28 is lifted up and then lowered down to approach the discharge outlet 24 located below the valve rod 28, the valve rod 28 pressurizes the viscous liquid in the reservoir 21 to thereby dispense the viscous liquid to the outside through the discharge outlet 24.

The lever 26 and the valve rod 28 may be connected to each other using various methods. According to the present embodiment, the lever 26 and the valve rod 28 are connected via simple insertion coupling as illustrated in FIG. 3. An engaging groove 27 that is horizontally opened is formed in an end portion of the lever 26. In embodiments, the engaging groove 27 of the lever 26 has a C-shape. An engaging rod 29 is provided at an upper end of the valve rod 28. The engaging rod 29 is inserted into the engaging groove 27 of the lever 26 so as to be rotatably connected to the lever 26. In embodiments, rotation of the lever 26 is converted to lifting movement of the valve rod 28.

As the engaging groove 27 is formed to be horizontally opened, the engaging groove 27 and the engaging rod 29 may be detached from each other by moving the engaging rod 29 with respect to the engaging groove 27 in a horizontal direction. In addition, as the engaging groove 27 is formed in a horizontal direction, even when the engaging groove 27 is lifted or lowered due to rotation of the lever 26, the engaging rod 29 is not deviated from the engaging groove 27. When separating the lever 26 and the valve rod 28 from each other according to necessity, they may be easily separated by moving the engaging rod 29 with respect to the engaging groove 27 in a horizontal direction.

As illustrated in FIG. 3, the first and second piezoelectric actuators 30 and 31 are installed in the pump body 15. Here, two piezoelectric actuators, in embodiments, the first and second piezoelectric actuators 30 and 31, are provided and rotate the lever 26 with respect to the hinge axis 16. The first piezoelectric actuator 30 and the second piezoelectric actuator 31 are each formed of a piezoelectric element. The first piezoelectric actuator 30 and the second piezoelectric actuator 31 are formed of piezoelectric elements whose length is increased or reduced according to an electrical potential of a voltage applied to the piezoelectric elements. In the present embodiment, description will focus on an example in which the first piezoelectric actuator 30 and the second piezoelectric actuator 31 are each formed of a multi-stack type piezoelectric actuator that is formed by stacking multiple piezoelectric elements.

The first piezoelectric actuator 30 and the second piezoelectric actuator 31 are arranged in the pump body 15 in parallel to each other in a vertical direction. The first piezoelectric actuator 30 and the second piezoelectric actuator 31 are arranged with the hinge axis 16 therebetween and such that lower ends thereof are each in contact with an upper surface of the lever 26. When a voltage is applied to the first piezoelectric actuator 30 and a length of the first piezoelectric actuator 30 is increased, the lever 26 rotates counter-clockwise with respect to FIG. 3, and when a voltage is applied to the second piezoelectric actuator 31 and a length of the second piezoelectric actuator 31 is increased, the lever 26 rotates clockwise with respect to FIG. 3.

When voltages are alternately applied to the first piezoelectric actuator 30 and the second piezoelectric actuator 31, the valve rod 28 is repeatedly lifted or lowered to continuously dispense the viscous liquid through the discharge outlet 24. As a distance between the hinge axis 16 and the first piezoelectric actuator 30 and the second piezoelectric actuator 31 is far greater than a distance between the hinge axis 16 and the valve rod 28, deformed lengths of the first piezoelectric actuator 30 and the second piezoelectric actuator 31 are sufficiently magnified by the lever 26. Movement of the lever 26 according to deformation in the lengths of the first piezoelectric actuator 30 and the second piezoelectric actuator 31 may operate the valve rod 28 within a sufficient height range of the valve rod 28. The pump control unit 33 controlling operations of the first piezoelectric actuator 30 and the second piezoelectric actuator 31 may apply a voltage having various pulse waveforms to the first piezoelectric actuator 30 and the second piezoelectric actuator 31 according to time, thereby controlling dynamic characteristics of the valve rod 28.

Referring to FIGS. 2 and 3, a first position adjustor 35 and a second position adjustor 36 are respectively disposed at upper ends of the first piezoelectric actuator 30 and the second piezoelectric actuator 31. The first position adjustor 35 and the second position adjustor 36 are screw-coupled to the pump body 15 while respective ends of the first position adjustor 35 and the second position adjustor 36 are in contact with respective ends of the first piezoelectric actuator 30 and the second piezoelectric actuator 31. The first position adjustor 35 adjusts a position of the first piezoelectric actuator 30 with respect to the lever 26 and the pump body 15, and the second position adjustor 36 adjusts a position of the second piezoelectric actuator 31 with respect to the lever 26 and the pump body 15. In embodiments, when the first piezoelectric actuator 30 is pressurized by tightening the first position adjustor 35, the first piezoelectric actuator 30 is lowered to approach or be closely adhered to the lever 26. The second position adjustor 36 also operates in the same manner as the first position adjustor 35.

The first and second piezoelectric actuators 30 and 31 are typically formed of a ceramic material. Expansion displacement of the first and second piezoelectric actuators 30 and 31 may be changed from an initial expansion displacement thereof according to an applied voltage after usage for a long period of time. In this case, dynamic characteristics of the discharge instrument 25 may be maintained by adjusting positions of the first piezoelectric actuator 30 and the second piezoelectric actuator 31 by using the first position adjustor 35 and the second position adjustor 36.

A first returning instrument 38 and a second returning instrument 39 are respectively installed under the first piezoelectric actuator 30 and the second piezoelectric actuator 31. The first returning instrument 38 is disposed in the pump body 15 to apply a force to the first piezoelectric actuator 30 in a direction in which the first piezoelectric actuator 30 is contracted. Likewise, the second returning instrument 39 is disposed in the pump body 15 to apply a force to the second piezoelectric actuator 31 in a direction in which the second piezoelectric actuator 31 is contracted. The first returning instrument 38 and the second returning instrument 39 may be, for example, springs that respectively provide an elastic force under the first piezoelectric actuator 30 and the second piezoelectric actuator 31 in a direction in which the first piezoelectric actuator 30 and the second piezoelectric actuator 31 are contracted, or may be fluid ducts.

Referring to FIG. 3, the displacement measurement sensor 40 is installed in the pump body 15 to measure an operation displacement of the lever 26 of the discharge instrument 25 and to provide the controller 44 with the measured operation displacement of the lever 26. The displacement measurement sensor 40 includes a probe 41 and a sensor body 42 to which the probe 41 is movably coupled. An end of the probe 41 is coupled to a middle of the lever 26 so that the probe 41 may be lifted or lowered in connection with rotation of the lever 26. The sensor body 42 detects a movement displacement of the probe 41 when the probe 41 is lifted or lowered, thereby detecting an operation displacement of the lever 26. In embodiments, the sensor body 42 measures an operation displacement of the lever 26 via the probe 41 and provides the controller 44 with the measured operation displacement of the lever 26. The controller 44 may calculate an operation stroke $S_o$ of the valve rod 28 (vertical operation displacement of the valve rod) based on the operation displacement of the lever 26.

As the lever 26 rotates with respect to the hinge axis 16, the probe 41 coupled to the lever 26 moves vertically while shaking to some extent in a horizontal direction. A rotation angle displacement of the lever 26 is very small, and thus a degree of horizontal shaking of the probe 41 is also relatively small. Thus, by appropriately designing an arrangement structure of internal components of the sensor body 42 and the probe 41, the probe 41 may be moved vertically without interfering with the internal components of the sensor body 42. Accordingly, an operation displacement of the lever 26 may be easily measured via the probe 41.

Figure 4:
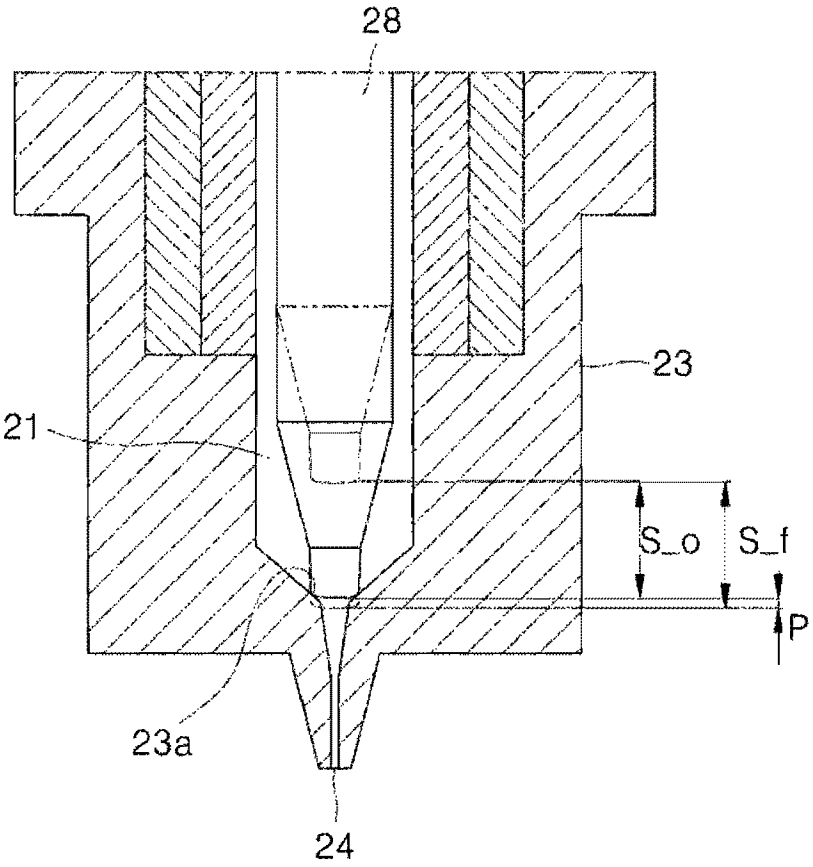
FIG. 4 is a cross-sectional view illustrating a nozzle of a piezoelectric dispenser and peripheral components therearound according to an embodiment of the inventive concept.

Referring to FIG. 4, a stroke of the discharge instrument 25 may be classified as a free stroke S_f and an operation stroke S_o. The operation stroke S_o denotes an actual distance traveled by the valve rod 28 inside the reservoir 21. The, and the free stroke S_f denotes a value obtained by adding a pressed value or over-stroke P to the operation stroke S_o. In embodiment, the nozzle 23 and the valve rod 28 are formed of a rigid material, such as a metal, which is sufficiently rigid to inhibit the valve rod 28 from digging into the valve seat portion 23*a* of the nozzle 23 by compressing the valve seat portion 23*a* of the nozzle 23. The pressed value or over-stroke P denotes a virtual distance that the valve rod 28 would move or travel beyond the point of the valve seat portion 23*a* if the nozzle is not provided. The pressed value or over-stroke P may otherwise denote a virtual distance that the valve rod would further travel after contacting the valve seat portion 23*a* if the nozzle 23 travels along with the valve rod without any resistance against the valve rod's movement after the valve rod contacts the valve seat portion. The piezoelectric actuators is set to operate to provide the free stroke S_f of the valve rod. In the illustrated embodiments, since the nozzle is fixed to the pump body and is sufficiently rigid and the piezoelectric actuators is set to operate to provide the free stroke S_f of the valve rod, the valve rod reciprocates with the operation stroke S_o and the valve rod further pushes the valve seat portion after the valve rod contacts the valve seat portion. The force applied by the valve rod to the valve seat portion may depend upon the over-stroke P. Thus, when the pressing value P increases, the force applied by the valve rod 28 to the valve seat portion 23*a* is also increased. By including the pressing value P in a stroke of the discharge instrument 25, the valve rod 28 may be compressed with respect to the valve seat portion 23*a* with a predetermined pressure, and leakage of the viscous liquid of the reservoir 21 through the discharge outlet 24 may be avoided or minimized when a dispensing operation of the viscous liquid is not performed. The pressing value P may be set to various values based on a type or viscosity of the viscous liquid.

A position of the probe 41 of the displacement measurement sensor 40 with respect to the lever 26 is not the same as a position of the valve rod 28 with respect to the lever 26, and thus the movement displacement of the probe 41 and the operation displacement of the valve rod 28 are different. A distance from the hinge axis 16 to the probe 41 and a distance from the probe 41 to the engaging rod 29 of the valve rod 28 are each uniform, and thus, an operation stroke S_o of the valve rod 28 (vertical movement displacement of the valve rod) may be easily calculated based on the movement displacement of the probe 41. The operation stroke S_o of the valve rod 28 may be measured while the valve rod 28 is connected to the lever 26, and a free stroke S_f of the valve rod 28 may be measured while the valve rod 28 is separated from the lever 26.

The controller 44 applies a voltage so as to operate the first and second piezoelectric actuators 30 and 31 via the pump control unit 33 that controls the first and second piezoelectric actuators 30 and 31 in the piezoelectric pump 12. Also, the controller 44 receives an operation displacement of the lever 26 from the displacement measurement sensor 40 and calculates an operation stroke S_o of the valve rod 28 based on the operation displacement of the lever 26. An input device 45 and a display 47 are integrally formed with the controller 44. The input device 45 includes a plurality of operation buttons 46 used to input various types of input data. A user may input an offset value of the operation stroke S_o of the valve rod 28 or the like via the operation buttons 46 of the input device 45. The controller 44 receives an offset value of the operation stroke S_o of the valve rod 28 of the user or the like via the input device 45. The display 47 displays various information such as the operation stroke S_o of the valve rod 28 or input data input by the user. The input device 45 and the display 47 may also be installed outside the controller 44 so as to be electrically connected to the controller 44.

The controller 44 may receive a measured operation displacement of the lever 26 from the displacement measurement sensor 40 and display various information on the display 47. The controller 44 may display, for example, an operation displacement of the lever 26, an operation stroke S_o of the valve rod 28, or a difference between a preset initial operation stroke S_i and a calculated operation stroke S_o of the valve rod 28, on the display 47. Also, the controller 44 may control a voltage to be applied to the first and second piezoelectric actuators 30 and 31 according to an offset value input by the user to thereby offset an operation stroke S_o of the valve rod 28. Here, offsetting an operation stroke S_o of the valve rod 28 indicates increasing or decreasing each of an upper limit value and a lower limit value of movement of the valve rod 28 by an identical distance while maintaining a uniform amount of vertical operation displacement of the valve rod 28. A method of offsetting an operation stroke of the discharge instrument 25 as described above will be described in detail later.

The piezoelectric dispenser 10 according to the present embodiment further includes cooling lines 48 and 49 to cool the first and second piezoelectric actuators 30 and 31. The cooling lines 48 and 49 are installed in the pump body 15. A cooling liquid flows to portions around the first and second piezoelectric actuators 30 and 31 through the cooling lines 48 and 49. Due to characteristics of the first and second piezoelectric actuators 30 and 31, a large amount of heat is generated in the first and second piezoelectric actuators 30 and 31 during use thereof. When temperatures of the first and second piezoelectric actuators 30 and 31 increase due to heat generated in the first and second piezoelectric actuators 30 and 31, operating characteristics thereof may be degraded. The pump body 15 may be cooled by passing through the mounting space of the first and second piezoelectric actuators 30 and 31 by using the cooling lines 48 and 49 to thereby avoiding or minimizing an increase in temperatures of the first and second piezoelectric actuators 30 and 31.

According to the piezoelectric dispenser 10 of the present embodiment, as the pump body 15 and the valve body 20 are detachably configured from each other, and the lever 26 and the valve rod 28 are also easily connectably and separably configured to and from each other, maintenance, repair and cleaning thereof is easy, and the piezoelectric pump 12 may be easily configured according to various characteristics of a viscous liquid. By unscrewing a screw coupling the pump body 15 and the valve body 20, and detaching the engaging rod 29 of the valve rod 28 from the engaging groove 27 of the lever 26, the valve body 20 and the valve rod 28 may be easily separated from the pump body 15. When the valve body 20 is separated, it is easy to clean the same for next use. Also when the valve body 20 or the valve rod 28 is damaged, they may be separated using the above-described method, and a new valve body 20 or a new valve rod 28 may be easily replaced.

When the pump body 15 or the valve body 20 is separated and then reassembled, or when the lever 26 and the valve rod 28 are separated and reassembled, for maintenance, repair or cleaning of components as described above, an operation stroke S_o of the valve rod 28 may be changed due to, an assembly tolerance or the like. When the operation stroke S_o of the valve rod 28 is changed, a discharge amount of a viscous liquid according to an operation of the piezoelectric pump 12 is changed from an initial discharge amount of the viscous liquid, and a pressing value P of the valve rod 28 is changed. A change in the operation stroke S_o of the valve rod 28 may also be caused by abrasion of components such as the lever 26, the valve rod 28, and the valve seat portion 23*a*.

Change in the operation stroke S_o of the valve rod 28 as described above may be adjusted by using a method of calibrating an operation stroke of a piezoelectric dispenser according to an embodiment of the inventive concept. Hereinafter, a method of calibrating an operation stroke of a piezoelectric dispenser according to an embodiment of the inventive concept will be described in detail.

Figure 5:
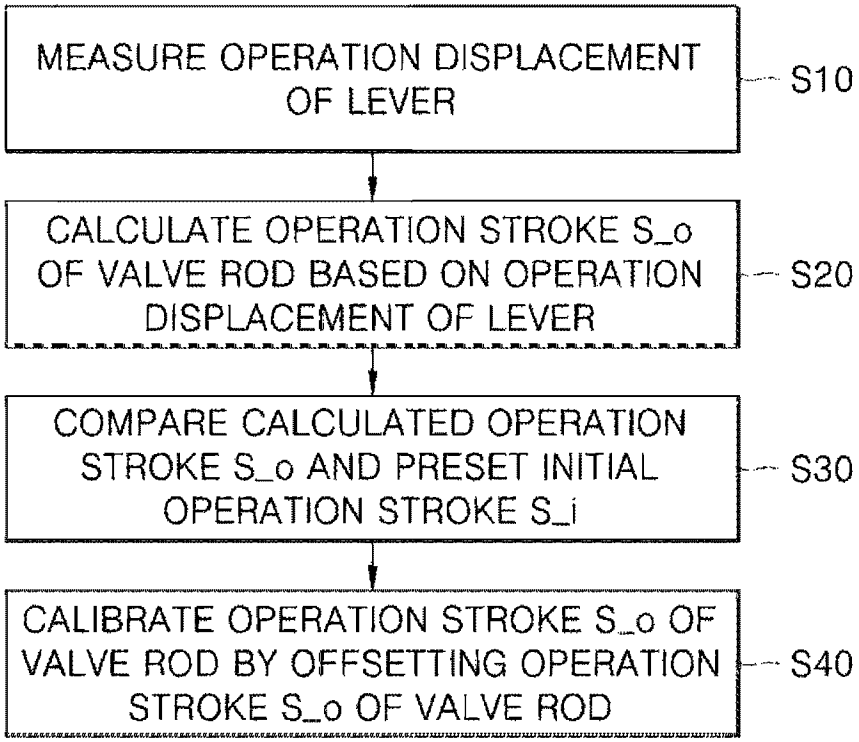
FIG. 5 is a flowchart of a method of calibrating a stroke of a piezoelectric dispenser according to an embodiment of the inventive concept, in an order.

As illustrated in FIG. 5, the method of calibrating an operation stroke of a piezoelectric dispenser according to the present embodiment includes measuring an operation displacement of the lever 26 (S10), calculating an operation stroke S_o of the valve rod 28 (S20), comparing the operation stroke S_o and an initial operation stroke S_i of the valve rod (S30), and offsetting the operation stroke S_o of the valve rod 28 (S40).

First, the controller 44 applies a voltage to the first and second piezoelectric actuators 30 and 31 to operate the discharge instrument 25 and measures an operation displacement of the lever 26 by using the displacement measurement sensor 40 (S10, step (a)).

The controller 44 calculates an operation stroke S_o of the valve rod 28 based on the measured operation displacement of the lever 26 measured in step (a) (S20, step (b)).

Figure 6:
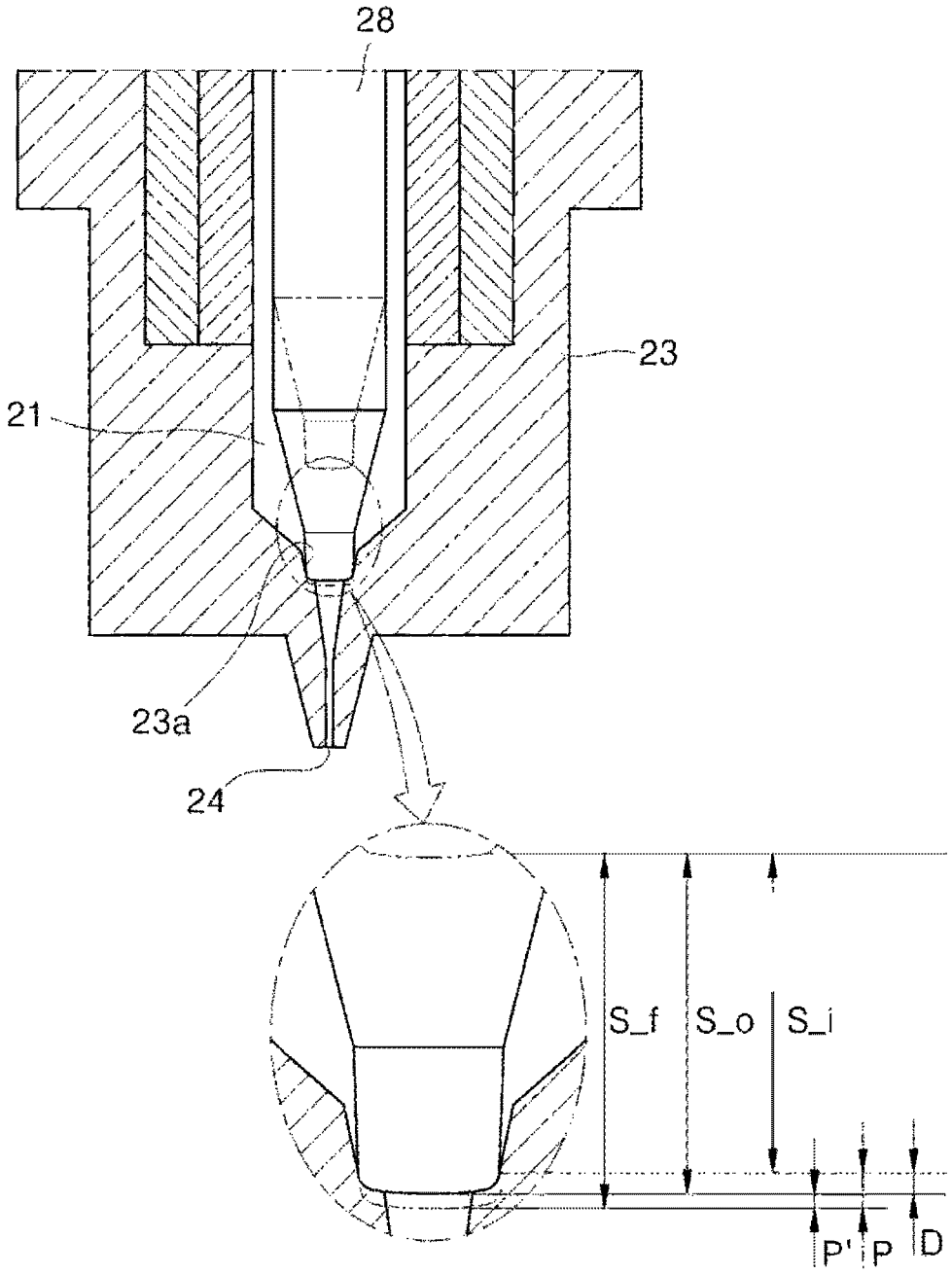
FIG. 6 is a view for describing an example in which a stroke of a valve rod included in a piezoelectric dispenser according to an embodiment of the inventive concept is modified.

Next, the controller 44 compares the calculated operation stroke S_o of the valve rod 28 with a preset initial operation stroke S_i thereof (S30, step (c)). The initial operation stroke S_i is a value that is preset when the piezoelectric pump 12 is manufactured or according to a type of a viscous liquid or the like. As illustrated in FIG. 6, when the valve seat portion 23*a* of the nozzle 23 is worn out, for example, even though an uppermost position of the valve rod 28 that operates vertically is the same as an uppermost position thereof when the valve seat 23*a* is not worn out, a lowermost position of the valve rod 28 is further below from a normal lowermost position of the valve rod 28 by a height corresponding to a worn portion of the valve seat portion 23*a*. Thus, the operation stroke S_o of the valve rod 28 is different from the initial operation stroke S_i thereof. During an operation of the piezoelectric pump 12, as the valve rod 28 is continuously compressed with respect to the valve seat portion 23*a* of the nozzle 23, the valve seat portion 23*a* may be worn away. In this case, even if a free stroke S_f of the valve rod 28 is not changed, the valve rod 28 is further moved towards the discharge outlet 24 by an amount corresponding to the worn portion of the valve seat portion 23*a* so that the operation stoke S_o of the valve rod 28 is greater than the initial operation stroke S_i thereof. A pressing value P' of the valve rod 28 is smaller than an initial pressing value thereof. When the operation stroke S_o and the pressing value P of the valve rod 28 are changed as above, a dispensing amount of a viscous liquid may be changed or the viscous liquid may leak.

When there is a difference between the operation stroke S_o and the preset initial operation stroke S_i of the valve rod 28, the controller 44 calibrates the operation stroke S_o of the valve rod 28 by offsetting the operation stroke S_o of the valve rod 28 by a difference D between the operation stroke S_o of the valve rod 28 and the initial operation stroke S_i thereof (S40, step (d)). The operation stroke S_o of the valve rod 28 may be offset by controlling a voltage to be applied to the first and second piezoelectric actuators 30 and 31.

Figure 7:
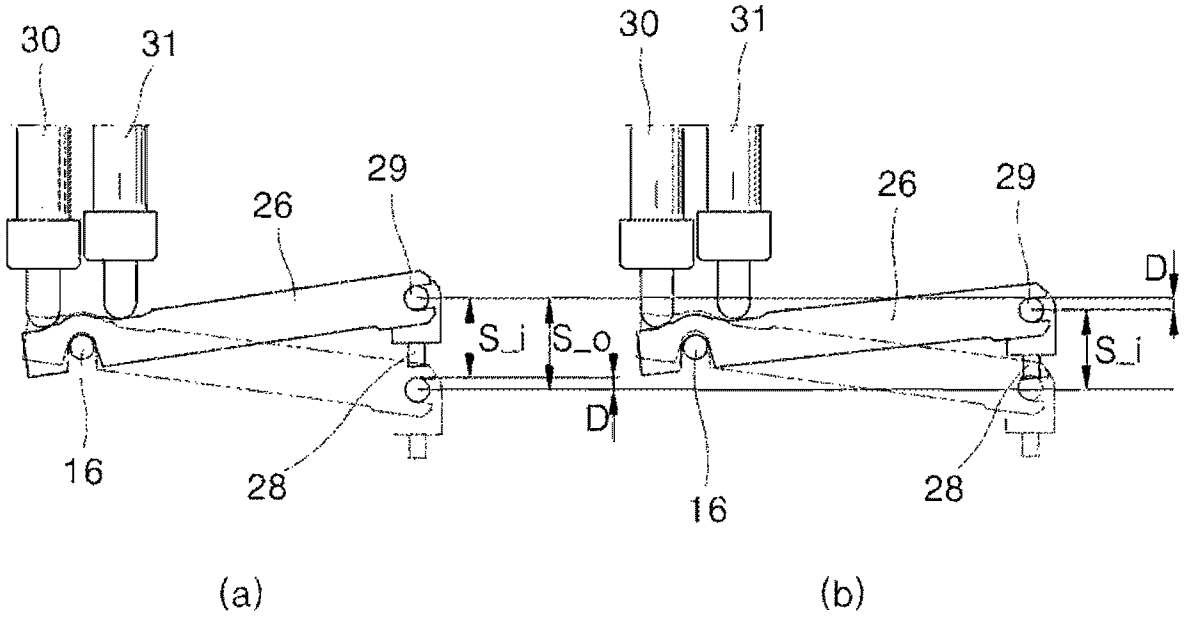
FIG. 7 is a view for describing a method of calibrating an operation stroke of a piezoelectric dispenser according to an embodiment of the inventive concept, by offsetting the operation stroke of the valve rod.

Referring to FIG. 6 and (a) of FIG. 7, when the valve seat portion 23*a* is worn away, the valve rod 28 that moves vertically is moved further below from an initial installation location of the valve rod 28 by an amount D of a worn portion of the valve seat portion 23*a* way. In this case, as illustrated in (b) of FIG. 7, the controller 44 controls a voltage to be applied to the first and second piezoelectric actuators 30 and 31 to offset the operation stroke S_o of the valve rod 28 downwards by the difference D between the initial operation stroke S_i and the operation stroke S_o of the valve rod 28. In embodiments, the controller 44 lowers a lifting height of the valve rod 28 by the difference D between the initial operation stroke S_i and the operation stroke S_o of the valve rod 28 by reducing a voltage to be applied to the first piezoelectric actuator 30. On the contrary, the controller 44 lowers a lowering height of the valve rod 28 also by the difference D by increasing a voltage to be applied to the second piezoelectric actuator 31. By controlling voltages applied to the first and second piezoelectric actuators 30 and 31, a uniform vertical operation displacement of the valve rod 28 may be maintained, and just an upper limit value and a lower limit value of the vertical operation displacement of the valve rod 28 may be varied by the same amount, and an initial pressing value P of the valve rod 28 may be maintained.

Calibration of an operation stroke S_o of the valve rod 28 by offsetting the operation stroke S_o of the valve rod 28 as above may be semi-automatically performed by the user. In this case, the controller 44 calculates an operation stroke S_o of the valve rod 28 based on an operation displacement of the lever 26, and then displays the calculated operation stroke S_o of the valve rod 28 on the display 47 (step (e)). The user determines the operation stroke S_o of the valve rod 28 displayed on the display 47, and inputs an offset value used to offset the operation stroke S_o of the valve rod 28. Here, the controller 44 may calibrate the operation stroke S_o of the valve rod 28 by offsetting the operation stroke S_o of the valve rod 28 by controlling a voltage to be applied to the first and second piezoelectric actuators 30 and 31 according to the input offset value.

Calibration of an operation stroke S_o of the valve rod 28 may also be performed automatically, instead of by the user. In this case, the controller 44 calculates an operation stroke S_o of the valve rod 28 and calculates an offset value according to a set program, and controls a voltage to be applied to the first and second piezoelectric actuators 30 and 31 based on the calculated offset value, thereby automatically calibrating the operation stroke S_o of the valve rod 28.

Calibration of an operation stroke S_o of the valve rod 28 by using the controller 44 may be performed in real time during a dispensing operation of a viscous liquid. In embodiments, the controller 44 may measure an operation displacement of the lever 26 in real time, and may calibrate the operation stroke S_o of the valve rod 28 in real time by offsetting the operation stroke S_o of the valve rod 28 by using the above-described method. During the dispensing operation of the viscous liquid, the operation stroke S_o of the valve rod 28 may be changed due to various factors such as expansion or contraction of components according to a temperature change. Thus, by calibrating the operation stroke S_o of the valve rod 28 in real time during dispensing of a viscous liquid, degradation of a dispensing quality due to a change in the operation stroke S_o of the valve rod 28 caused by peripheral factors or the like may be reduced.

As described above, according to the piezoelectric dispenser 10 of the present embodiment, the pump body 15 and the valve body 20 may be detachably configured from each other and the lever 26 and the valve rod 28 may also be easily connectably and separably configured to and from each other, and thus it is easy to maintain, repair, and clean the piezoelectric dispenser 10, and to configure the piezoelectric pump 12 according to various characteristics of a viscous liquid. When separating the pump body 15 and the valve body 20 and reassembling the same for maintenance, repair, or cleaning of components, an operation stroke S_o of the valve rod 28 may be changed from an initial value thereof. In addition, an operation stroke S_o of the valve rod 28 may also be changed from an initial value thereof due to abrasion of components after usage for a long period of time. In this case, the operation stroke S_o of the valve rod 28 is calculated based on an operation displacement of the lever 26 that is measured using the displacement measurement sensor 40, and the operation stroke S_o of the valve rod 28 is offset to thereby calibrate the operation stroke S_o of the valve rod 28 such that the operation stroke S_o of the valve rod is the same as the initial value, thereby maintaining the initial dispensing performance of the viscous liquid.

While it is described above that the operation stroke S_o of the valve rod 28 is calibrated when the pump body 15 and the valve body 20 are reassembled, the operation stroke S_o of the valve rod 28 may also be calibrated in various situations other than in the case of reassembly of the pump body 15 and the valve body 20. For example, the operation stroke S_o of the valve rod 28 may be changed also due to abrasion of components, and thus, the operation stroke S_o of the valve rod 28 may be calibrated by setting the operation stroke S_o of the valve rod 28 to an initial value after the piezoelectric pump 12 is used for a predetermined period of time.

Figure 8:
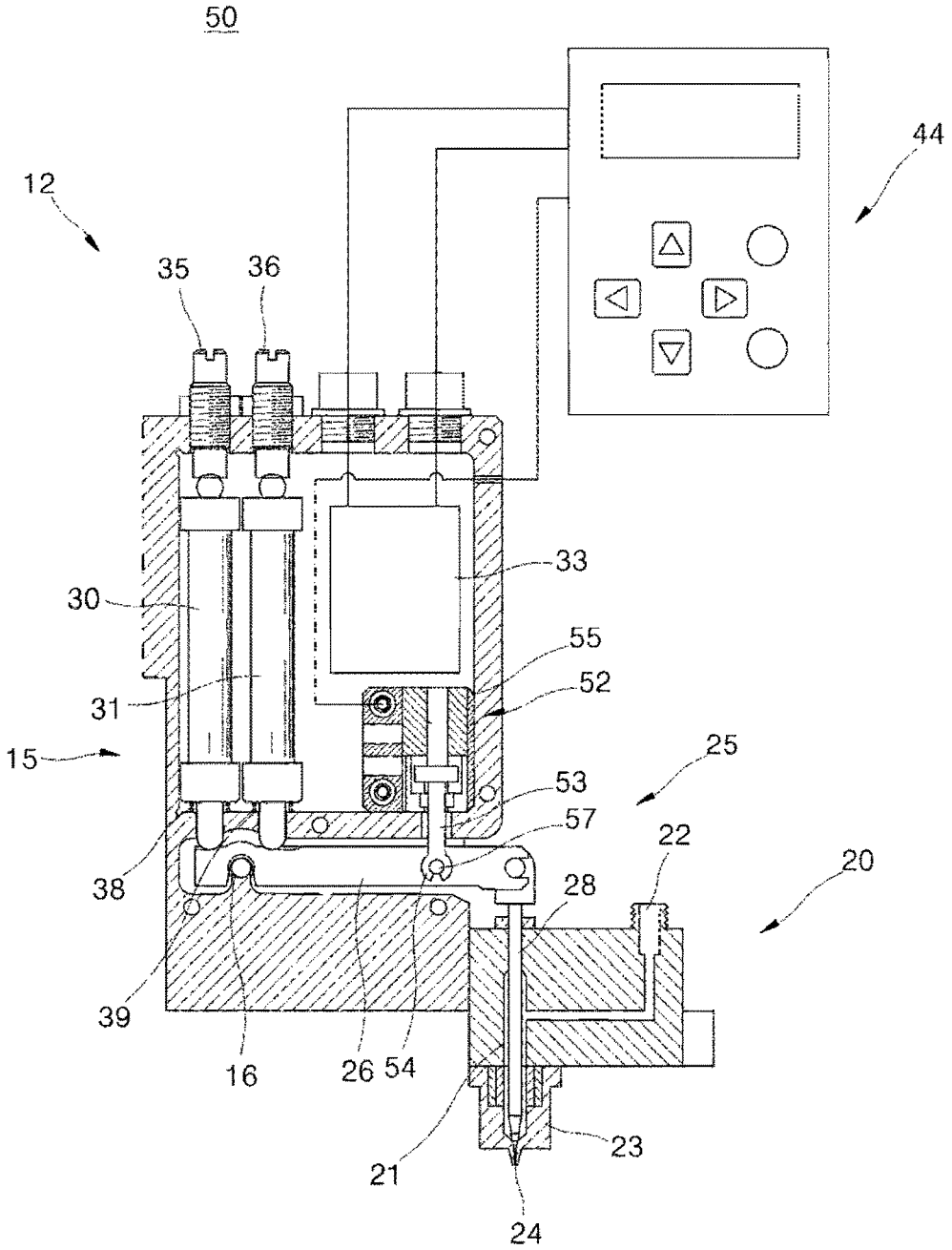
FIG. 8 illustrates a piezoelectric dispenser according to another embodiment of the inventive concept.
Figure 9:
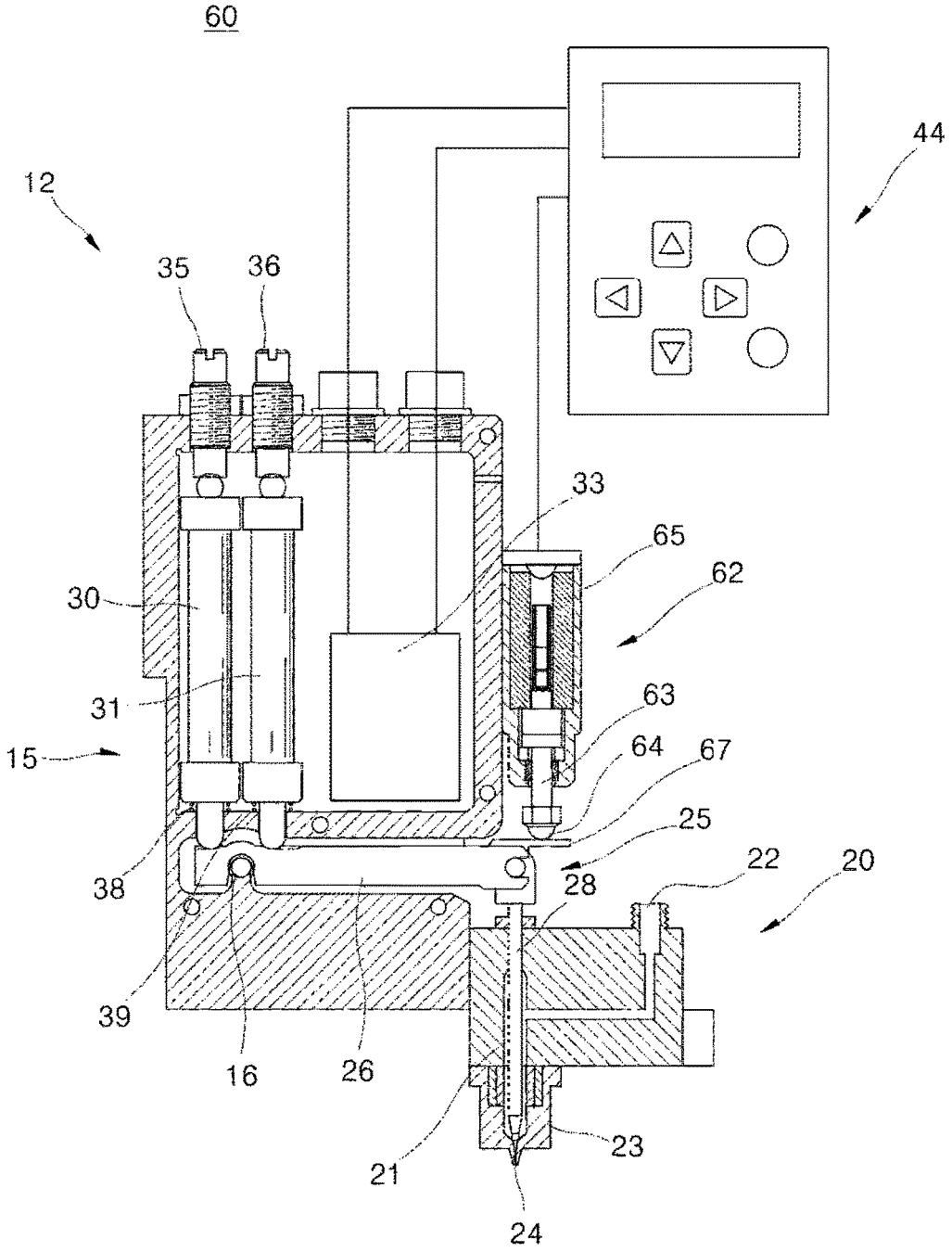
FIG. 9 illustrates a piezoelectric dispenser according to another embodiment of the inventive concept.

According to the embodiments of the inventive concept, a specific structure of a displacement measurement sensor used to measure an operation displacement of the lever 26 or a connection structure between the displacement measurement sensor and the discharge instrument 25 may be modified in various manners. For example, FIGS. 8 and 9 illustrate various modified examples of a piezoelectric dispenser including a displacement measurement sensor having a modified structure.

First, a piezoelectric dispenser 50 according to another embodiment of the inventive concept includes a piezoelectric pump 12, a displacement measurement sensor 52, and a controller 44. The piezoelectric pump 12 and the controller 44 are the same as those described above.

The displacement measurement sensor 52 is installed in the pump body 15 to detect an operation displacement of the lever 26 and provide the controller 44 with a detection signal corresponding to the operation displacement of the lever 26. The displacement measurement sensor 52 includes a probe 53 and a sensor body 55 to which the probe 53 is movably coupled. An end of the probe 53 is rotatably coupled to a pivot pin 57 located in a middle of the lever 26 so that the probe 53 may be lifted or lowered in connection with rotation of the lever 26. A coupling groove 54 is formed at the end of the probe 53 so as to be coupled to the pivot pin 57, thereby inserting the pivot pin 57 into the coupling groove 54.

When the lever 26 rotates with respect to the hinge axis 16 due to operations of the first and second piezoelectric actuators 30 and 31, the probe 53 rotates with respect to the pivot pin 57 in connection with rotation of the lever 26, and is vertically moved at the same time. A guide instrument that guides the probe 53 such that the probe 53 moves vertically and linearly without horizontally shaking is included in the sensor body 55.

Meanwhile, a piezoelectric dispenser 60 according to another embodiment of the inventive concept illustrated in FIG. 9 includes a piezoelectric pump 12, a displacement measurement sensor 62, and a controller 44. The piezoelectric pump 12 and the controller 44 are the same as those described above.

The displacement measurement sensor 62 is coupled to an external surface of the pump body 15 so as to detect an operation displacement of the lever 26 and provide the controller 44 with a detection signal corresponding to the operation displacement of the lever 26. The displacement measurement sensor 62 includes a probe 63 and a sensor body 65 to which the probe 63 is movably coupled. An end of the probe 63 is in contact with an external surface of an extension portion 67 extending to an end of the lever 26 so that the probe 63 may be lifted or lowered in connection with rotation of the lever 26. A curved contact surface 64 that is in sliding contact with a surface of the lever 26 is formed on the end of the probe 53.

While the piezoelectric dispenser and the method of calibrating operation stroke of the piezoelectric dispenser according to the embodiments of the inventive concept have been described above, the scope of the inventive concept is not limited to the described and illustrated embodiments.

For example, the lever 26 and the valve rod 28 may be connected to each other also using other methods than a method of using the engaging groove 27 of the lever 26 and the engaging rod 29 of the valve rod 28. The discharge instrument 25 may be modified to another structure than the structure including the lever 26 and the valve rod 28, and the pump body 15 and the valve body 20 may be integrally formed with each other instead of being detachably coupled to each other.

In addition, besides the so-called probe sensor implemented and illustrated above as the displacement measurement sensor for detecting an operation displacement of the lever 26, a displacement measurement sensor having various structures to detect an operation displacement of the lever 26 in a contact or non-contact manner and provide the controller 44 with a detection signal corresponding to the detected operation displacement of the lever 26 may be used.

In embodiments, to adjust changes of dispensing amount back to the preset value, a liquid dispenser apparatus includes a lever's position detector for detecting the lever's position which is indicative the valve rod's position. In one embodiment, the lever's position may be a relative position of the lever relative to a reference position of the lever. This relative position may indicate a displacement from the reference position. This displacement of the lever may be indicative of the displacement of the valve rod (or the tip of the valve rod which contacts a valve seat of the nozzle) which may be a stroke of the valve rod. This displacement may be a linear displacement or an angular displacement. In another embodiment, the lever's position may be a relative position of any other reference point, for example, an axis of the hinge of the lever.

In the illustrated embodiments, the dispensing apparatus includes one or more control circuits which include one or more processors and a memory which contain a program for controlling the operation of the piezoelectric actuators. The one or more processors may process the information of the lever's position, for example, the displacement of the lever, from the lever-position sensor to generate a control signal. The control signal is to change the voltage signal applied to the piezoelectric actuators to adjust a level of expansion and shrinkage of the piezoelectric actuators. Such change of the voltage signal may change the valve rod position without change of the stroke. In alternative embodiments, the stroke may be slightly changed.

According to the piezoelectric dispenser according to the inventive concept, when an operation stroke of a valve rod is changed from an initial value due to various factors during use of the piezoelectric dispenser, the operation stroke of the valve rod is calibrated by setting the same to an initial value by offsetting the operation stroke of the valve rod by controlling a voltage to be applied to the piezoelectric actuator. Accordingly, uniform dispensing performance of a viscous liquid may be maintained, and poor dispensing quality of a viscous liquid due to abrasion of components or the like may be reduced.

In addition, the operation stroke of the valve rod may be calibrated in real time during dispensing of a viscous liquid, thereby maintaining an optimum state of the dispensing quality of the viscous liquid.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the inventive concept as defined by the following claims.

What is claimed is:

1. A method of dispensing liquid, the method comprising:

providing a liquid dispenser that comprises a nozzle comprising a valve seat;

a valve rod comprising a tip;

at least one piezoelectric actuator configured to expand and shrink in response to electric signals, a lever operably connected to the at least one piezoelectric actuator and operably connected to the valve rod such that expansion and shrinkage of the at least one piezoelectric actuator cause pivotal movement of the lever about a pivot axis, which in turn causes reciprocation of the valve rod along a first axis, wherein the reciprocation of the valve rod involves repeated impacts by the tip of the valve rod on the valve seat of the nozzle, which causes wearing out of at least one of the valve seat and the tip of the valve rod over time, wherein wearing out of the at least one of the valve seat and the tip of the valve rod makes a stroke distance of the reciprocation longer;

applying a voltage signal to the at least one piezoelectric actuator for its expansion and shrinkage along a second axis being identical to or different from the first axis, which causes pivotal movement of the lever, which in turn causes the reciprocation of the valve rod along the first axis between a top end and a bottom end of the reciprocation for dispensing of liquid through the nozzle, wherein the tip of the valve rod contacts the valve seat and applies an impact onto the valve seat when the valve rod is at the bottom end of the reciprocation;

determining if the stroke distance has become longer;

in response to determining that the stroke distance has become longer, making the top end of the reciprocation lower in the first axis and decreasing the stroke distance by changing the voltage signal applied to the at least one piezoelectric actuator to compensate the wearing out of the at least one of the valve seat and the tip of the valve rod.

2. The method of claim 1, wherein determining comprises computing the stroke distance and then comparing the stroke distance to a reference value.

3. The method of claim 2, wherein it is determined that the stroke distance has become longer than before when the stroke distance has become longer than the reference value.

4. The method of claim 1, wherein the voltage signal operates the at least one piezoelectric actuator such that the valve rod would move to a preset position beyond the bottom end of the reciprocation if the nozzle does not stop the valve rod's movement, wherein an over-stroke distance defined by a distance between the bottom end and the preset position becomes shorter than a reference distance when the stroke distance becomes longer than a reference value, wherein the liquid dispenser generates a control signal that is to change the preset position for increasing the over-stroke distance to be greater than the reference distance.

5. The method of claim 1, wherein the liquid dispenser further comprises at least one processor and a lever-position detector that is a displacement sensor which senses the lever's position indicative of the tip's position relative to the top end or the bottom end of the reciprocation and provides information indicative of the lever's position to the at least one processor.

6. The method of claim 1, wherein the at least one piezoelectric actuator comprises a first piezoelectric actuator and the liquid dispenser further comprises a second piezoelectric actuator, wherein the first piezoelectric actuator expands and the second piezoelectric actuator shrinks to place the valve rod to the top end of the reciprocation, wherein when the stroke distance becomes longer than a reference value, the liquid dispenser generates a control signal that is to reduce the amount of the expansion of the first piezoelectric actuator and the amount of the shrinkage of the second piezoelectric actuator for changing the top end of the reciprocation.

* * * * *